US008371033B2

(12) United States Patent
Cantore, III et al.

(10) Patent No.: US 8,371,033 B2
(45) Date of Patent: Feb. 12, 2013

(54) ELECTRIC CAN OPENER AND METHOD OF OPENING A CAN

(76) Inventors: Joseph Michael Cantore, III, New York, NY (US); Michael Tobin, Dix Hills, NY (US); James Emmett Towey, New York, NY (US); Nisha Sawhney, New York, NY (US); Gennadi Fedorov, Blairstown, NJ (US)

( * ) Notice: Subject to any disclaimer, the term of this patent is extended or adjusted under 35 U.S.C. 154(b) by 384 days.

(21) Appl. No.: 12/858,836

(22) Filed: Aug. 18, 2010

(65) Prior Publication Data

US 2012/0042753 A1 Feb. 23, 2012

(51) Int. Cl.
*B67B 7/70* (2006.01)
*B67B 7/54* (2006.01)

(52) U.S. Cl. ..... 30/425; 30/434; 30/442

(58) Field of Classification Search ..... 30/420–427, 30/416–417, 434, 442
See application file for complete search history.

(56) References Cited

U.S. PATENT DOCUMENTS

| | | | | | |
|---|---|---|---|---|---|
| 2,963,629 | A | | 12/1960 | Rhodes | |
| 3,060,567 | A | * | 10/1962 | Boyett | 30/405 |
| 3,066,409 | A | * | 12/1962 | Smith | 30/403 |
| 3,156,044 | A | * | 11/1964 | Congdon et al. | 30/404 |
| 3,307,256 | A | * | 3/1967 | Powers | 30/410 |
| 3,487,965 | A | * | 1/1970 | Gale | 414/811 |
| 3,739,471 | A | * | 6/1973 | Peres | 30/433 |
| 3,791,029 | A | | 2/1974 | Yamamoto | |
| 3,898,898 | A | * | 8/1975 | Peres | 82/47 |
| 4,622,749 | A | * | 11/1986 | Inagaki | 30/421 |
| 5,396,838 | A | | 3/1995 | Casapulla | |
| 5,403,053 | A | * | 4/1995 | Zareck | 294/16 |
| D421,205 | S | * | 2/2000 | Naft et al. | D8/36 |
| 6,101,727 | A | * | 8/2000 | Chong | 30/418 |
| 6,112,650 | A | | 9/2000 | Mazzaccaro | |
| 6,516,524 | B1 | * | 2/2003 | Brady | 30/404 |
| D501,770 | S | | 2/2005 | De Bitonto et al. | |
| 6,886,260 | B1 | * | 5/2005 | Lee | 30/421 |
| 7,213,340 | B1 | * | 5/2007 | Lee | 30/416 |
| 7,353,607 | B2 | * | 4/2008 | So | 30/416 |
| 7,437,825 | B2 | * | 10/2008 | Sanders et al. | 30/422 |
| 7,574,808 | B2 | * | 8/2009 | Mah et al. | 30/404 |
| 7,587,831 | B2 | * | 9/2009 | So | 30/416 |
| 7,596,874 | B2 | * | 10/2009 | Mah et al. | 30/404 |
| 2002/0092430 | A1 | | 7/2002 | Dempsey | |
| 2005/0235501 | A1 | * | 10/2005 | So | 30/425 |
| 2009/0056285 | A1 | * | 3/2009 | Kramer et al. | 53/492 |
| 2010/0263492 | A1 | * | 10/2010 | Mah et al. | 81/3.2 |

OTHER PUBLICATIONS

International Search Report & Written Opinion, ISA/US, Jan. 6, 2012.

* cited by examiner

*Primary Examiner* — Ghassem Alie
*Assistant Examiner* — Bharat C Patel
(74) *Attorney, Agent, or Firm* — Gottlieb, Rackman & Reisman, P.C.

(57) ABSTRACT

To solve problems in a conventional electric can opening apparatus wherein it is impractical to drain the unwanted liquid from the inside of the can after opening the container and disposing of the top lid or top without touching it. The composite can opener includes a body with a gripping member gripping a can while an opening member cuts the top of the can open and a piston that selectively pushes the top into and out of the can after it has been cut.

8 Claims, 6 Drawing Sheets

ELECTRIC CAN OPENER AND METHOD OF OPENING A CAN

RELATED APPLICATIONS

NONE

BACKGROUND OF THE INVENTION

1. Field of Invention

The present invention relates to an apparatus for opening a can containing solids and liquids, and more particularly to a combination electric can opener and draining device used to sequentially open a can and, optionally drain the liquids there from while solids remain in the can.

2. Background of the Invention

Devices that can be used to open food cans or press their top after they are opened are known, for example from U.S. Pat. Nos. 5,403,053, 3,487,965A, 5,396,838, 6,112,650A and U.S. patent publication 20020092430A1. While all of the described prior art devices and methods are adequate for the basic purpose and function they are inadequate because they cannot be used to perform both operations satisfactorily. For example, cans often containing solid/liquid mixtures (for food stuff, generally, a meat or meat by-product, immersed in a liquid preservative). A person, frequently in a hurry, especially in the morning, must open the can, at least partially, using an electric can opener, drain the liquids there from, and then transfer the remaining solids to into an appropriate container. No existing devices are available that can be used to perform these steps relatively fast, and in a manner that insures that the person does not soil his hands or clothing.

As a consequence of the foregoing situation, there has existed a longstanding need for a new, practical and improved type of electric can opener and electric draining device combination.

SUMMARY OF THE INVENTION

A can opener constructed in accordance with this invention includes a body with a handle having a size and shape selected to fit in a person's hand, and a head integrally formed with the handle. Several control switches and indicator lights are provided on the handle. The head includes a downwardly extending portion with a sidewall formed with a conventional can opener assembly including a knife. The head further includes a lateral extension with a plunger extending downwardly.

The can opener is used as follows. A standard can with a circumferential rim is engaged by the can opener assembly and the can is then opened by cutting a circular cut in its top. The plunger is then forced downward causing the top to be pushed into the can and displace liquids therein. The can is then taken to a sink or garbage can and tilted to cause the liquid to be poured off. The plunger is the moved upward and it is provided with a magnet that lifts the can top out of the can. The remainder of the materials within the can now be removed. Electromechanical elements are mounted within the body and used to selectively operate the can opener assembly and the plunger. Preferably, the electromagnetic elements are powered by rechargeable batteries.

DETAILED DESCRIPTION OF THE INVENTION

Figure 1:
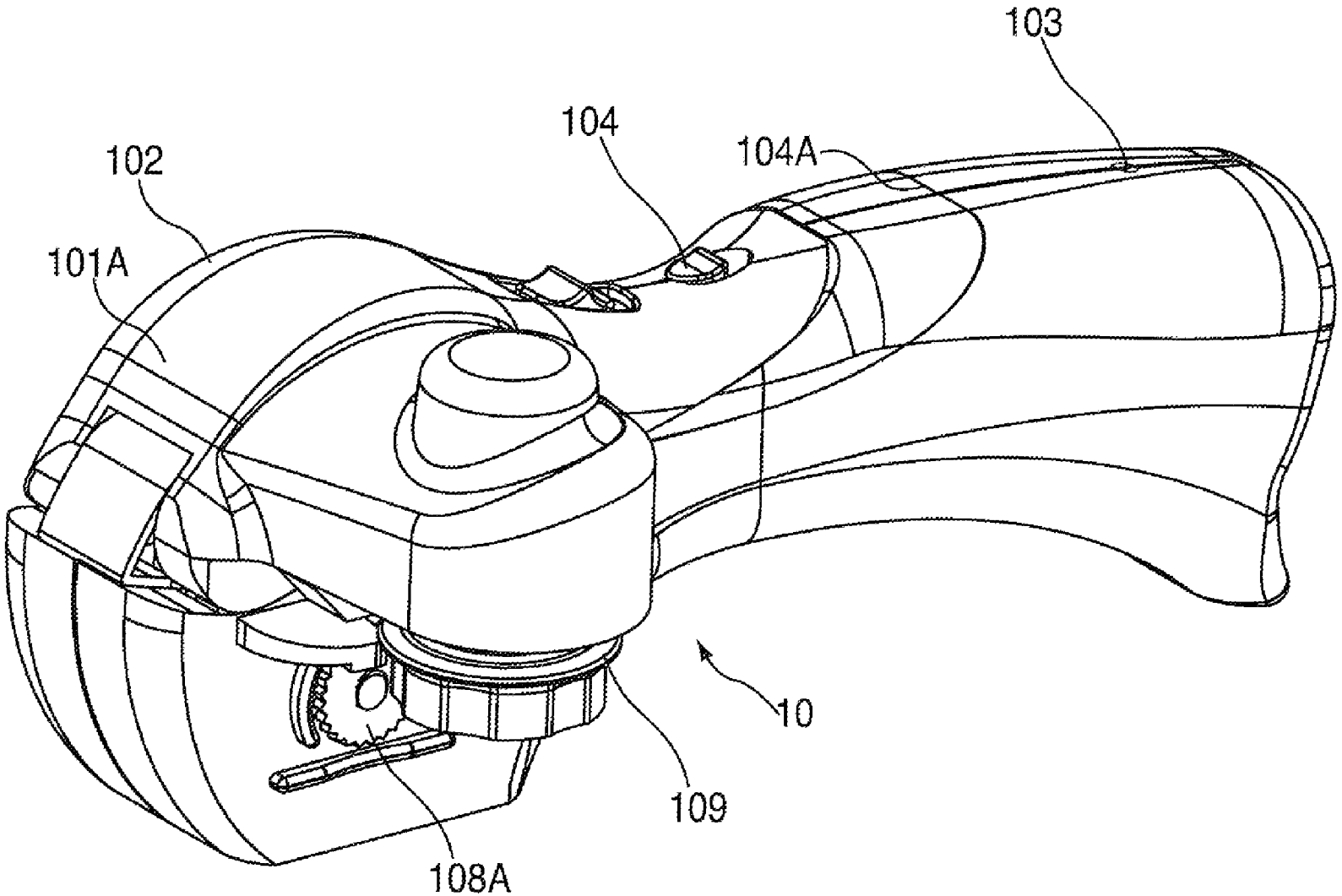
FIG. 1 is an isometric left view of a can opener constructed in accordance with this invention.

Referring to the drawings, an electric composite can opener 10 constructed in accordance with this invention has a main body 100 divided into two segments, a handle 101 and a head 102. The handle 101 is somewhat tubular and is sized and shaped to form a curved grip which allows a person to hold and operate the opener 10.

As shall be described in more detail below, preferably the composite can opener 10 is battery operated and is provided with conventional circuitry (not shown) to indicate the status of its internal rechargeable (or replaceable) battery. The handle 101 is formed with a small round opening 103 housing a battery indicator LED (not shown) which alerts the individual operating the can opener if the battery needs to be charged by turning red, or is ready for use when the LED turns green. The handle 101 is also provided with an additional hole formed in end wall 101*x*. See FIG. 3. This hole 115A (See FIG. 5) is used for a standard plug (not shown) connecting the batteries within the body 100 (discussed more fully below) powering the device. When the LED shows that the batteries are discharged, the user can connect the device to the plug which then provides standard AC for charging the batteries in a conventional manner. Alternatively, the device can be provided with disposable batteries, in which the opening 115A for the charging plug can be omitted. In yet another embodiment, the can opener is operated from an AC source.

The handle 100 is further provided with two switches 104, 105 found on its top surface and a long switch 107 found on its lateral surface. The functions of these switches are described in more detail below.

Figure 2:
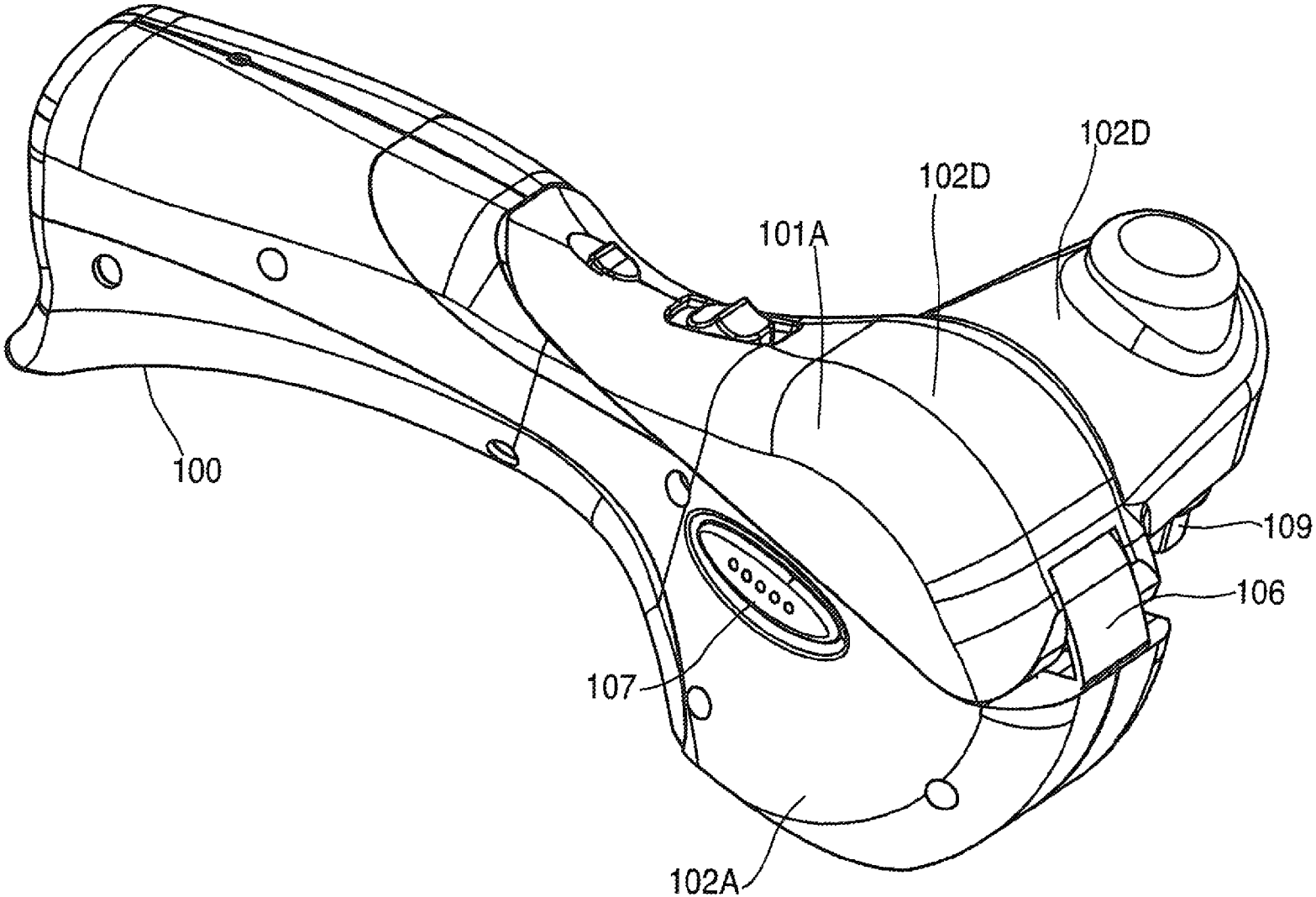
FIG. 2 is an isometric right view of the device of FIG. 1.
Figure 3:
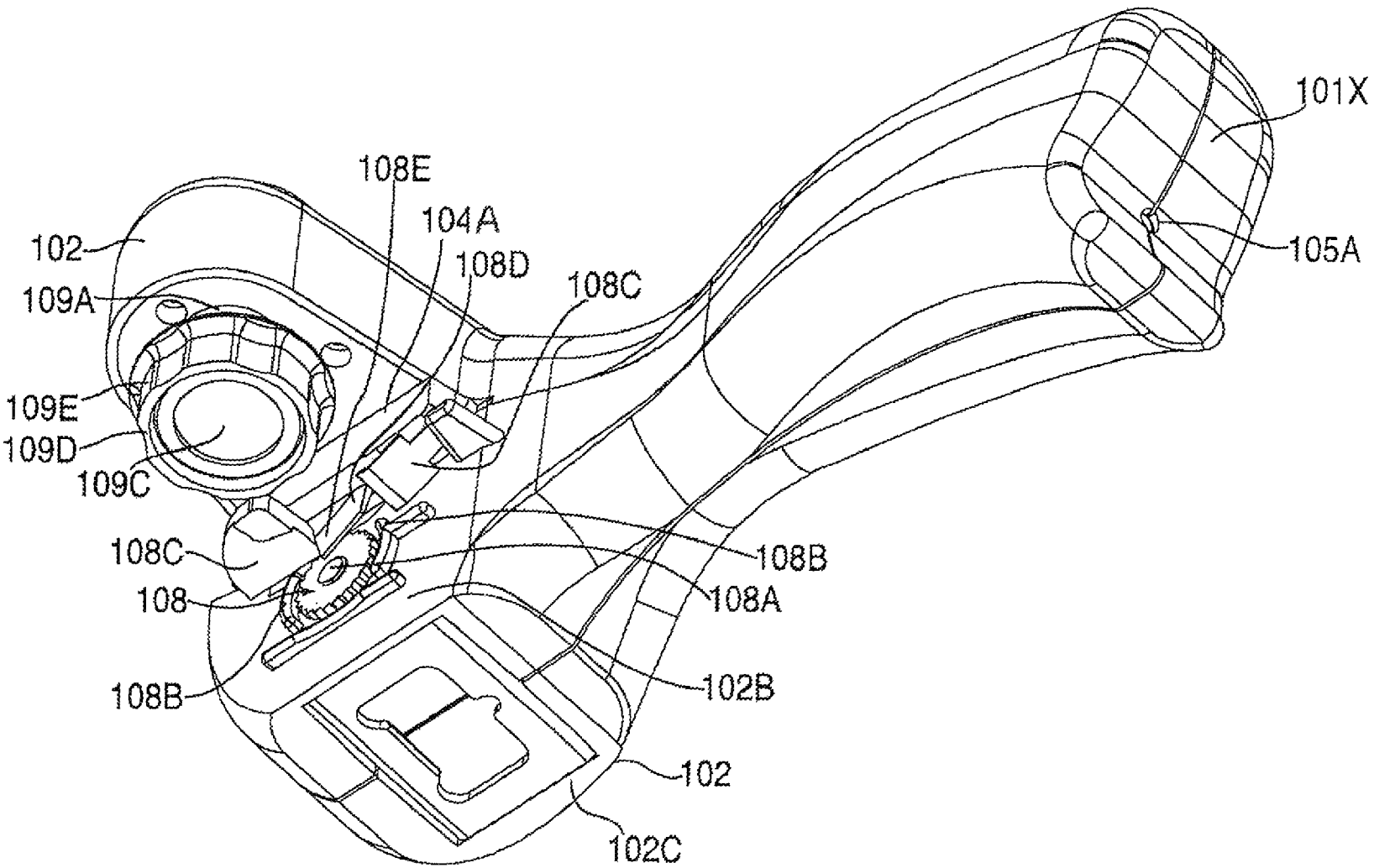
FIG. 3 is an isometric view of the device of FIG. 1 with the top opened to render its inner components visible.

The upper wall of the body 100 is formed with a top 101A (see FIG. 2) delineated by line 104A and having a hinge 106. The top 101A can be selectively separated from the body 100 to allow access to the interior of the body for assembly and servicing however, under normally usage, the body 100 and its top 101A remain integral and its interior is not accessible to the user for the sake of safety. For this purpose, the top 101A is attached to the rest of the body 100 by an adhesive, by one or more screws, or by other conventional means. The head 102 is formed with a bottom portions 102A having a side wall 102B (FIG. 3) and a bottom wall 102C. As best seen in FIG. 3, shows a can opener assembly 108 is supported on side wall 102B. The can opener 108 includes a toothed wheel 108A, two arcuate protective walls 108B, two spring-loaded or flexible arms 108C extending downwardly and a knife 108D having a v-shaped edge 108E. Importantly, the knife 108D has two positions, an upper position in which the its edge 108E is disposed above and slightly offset radially with respect to the toothed wheel 108A (not shown) and a lower position in which the knife 108D is disposed adjacent to the toothed wheel 108A.

On its bottom surface 102C the head 102 is provided with a standard bottle cap opener 118.

The head 102 further includes a lateral extension 102D with a plunger 109 (FIG. 3). A cylindrical hub 109A disposed around a disc 109B holding a magnet 109C(as described more fully below, and shown in FIG. 6).

Figure 4:
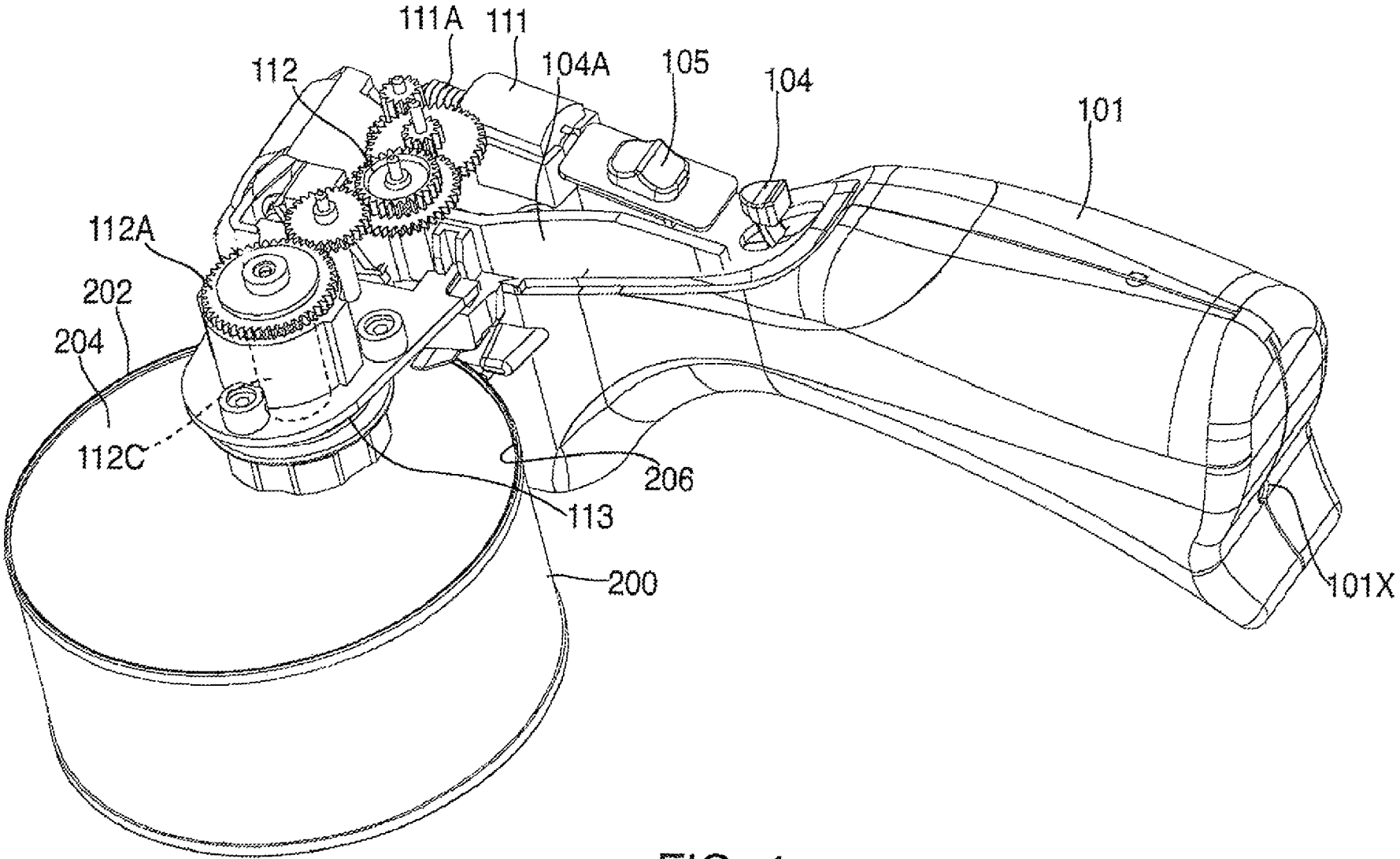
FIG. 4 is a side cross-sectional view of the device of FIGS. 1-3.
Figure 5:
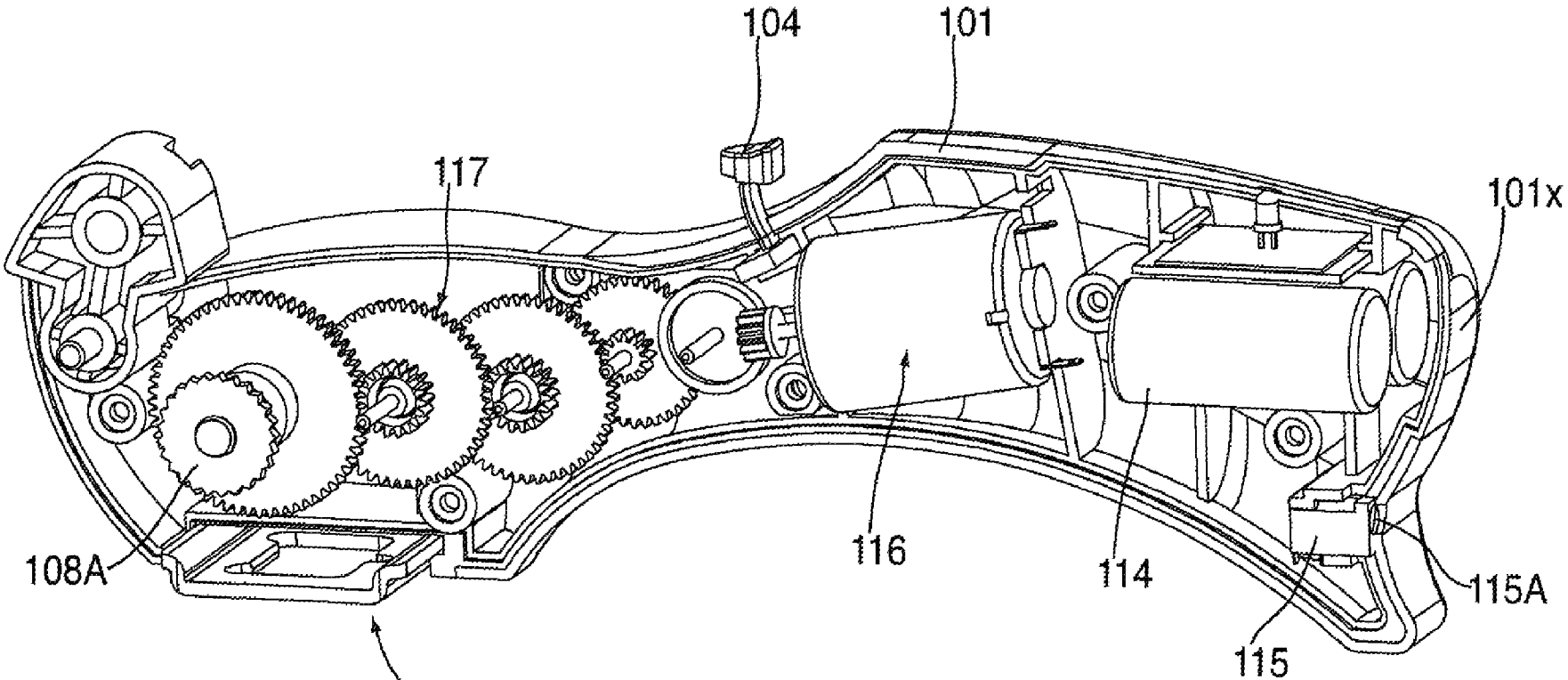
FIG. 5 is an isometric top cross sectional view of the device of FIGS. 1-4.

The internal elements of the can opener are now described in conjunction with FIGS. 4 and 5. Starting with FIG. 5, one or two batteries 114 are provided toward the rear of the handle 101 and are connected to an electronic charging circuit 115. As previously mentioned, plugs connecting the circuit 115 to a conventional AC source are inserted through opening 115A. The batteries 114 selectively energize a first drive mechanism including a first motor 116. The motor 116 is turned on and off by long switch 107 (preferably a momentary switch) and is used to activate a first drive mechanism including a gear train 117 driving the toothed wheel 108A.

An arm 104A is coupled to the top switch 104 .The knife 108D is attached to and supported by arm 104A. The arm 104A and top switch 104 cooperate so that when the top switch 104 is pushed forward, the knife 108D is pushed down and locked in place. When the top switch 104 is pushed back, the knife 108D is released and moves back up to its original position.

Figure 6:
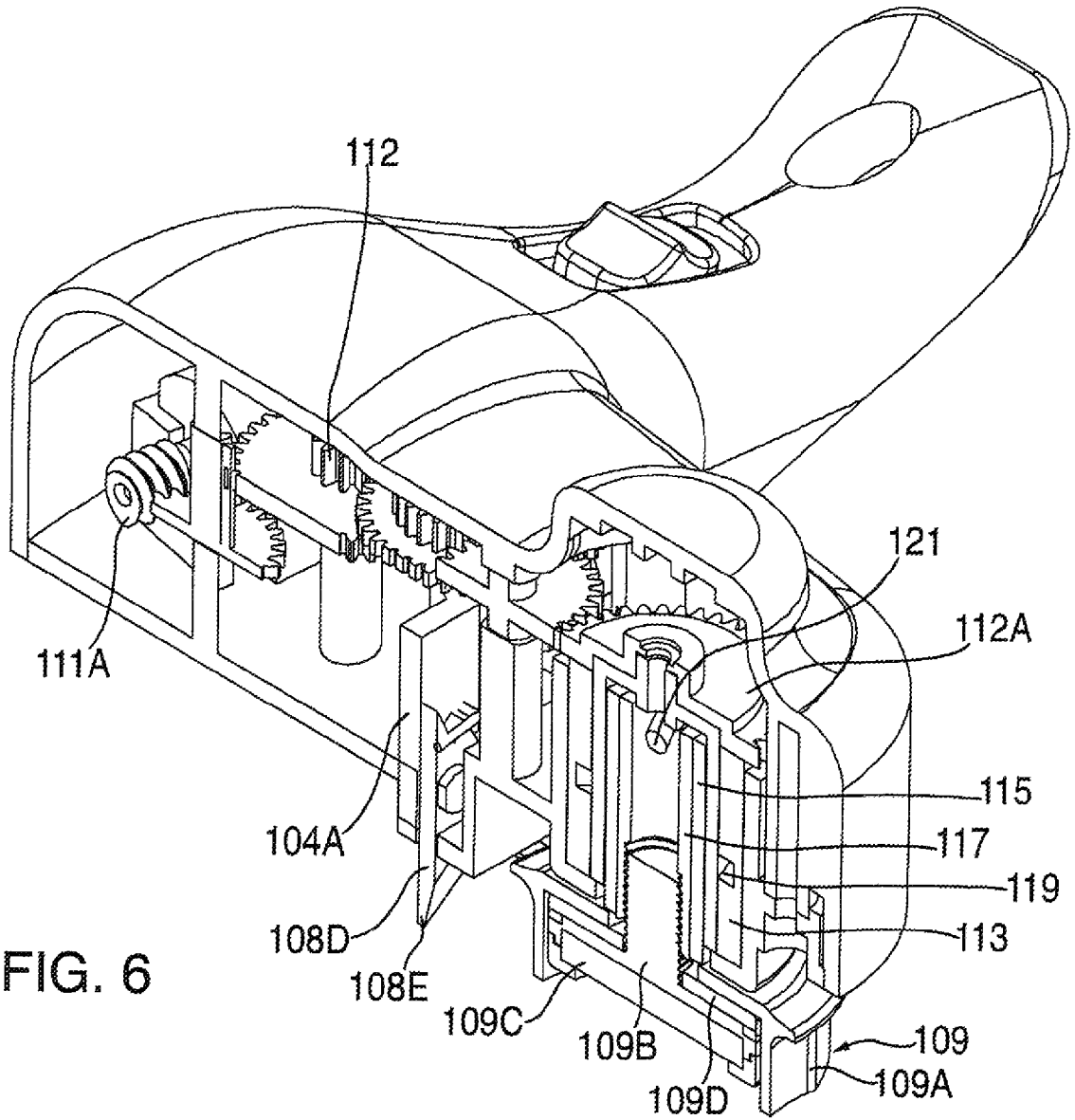
FIG. 6 shows a cross-sectional view of the can opener taken through the plunger.

As shown in FIGS. 5 and 6, there is provided a second drive mechanism consisting of a second motor 111 driving a worm gear 111A which then activates a drive train 112 including a toothed gear 112A. Under gear 112A and coaxial therewith there are three cylindrical shells 113, 115 and 117. Shell 113 is formed with a helical grove 119. An axial pin 121 is attached to 117. Pin 121 extends through shell 115 and into the groove 119. Shell 113 is attached to the gear 112A and therefore it rotates therewith. As a result, the groove 119 forms a caming surface for the pin and it is rotated in one direction or another, it forces the pin 121 and shells 115 and 117 to move up and down.

As seen in FIG. 6, the disc 109B and magnet 109C are attached to the bottom of shell 117. A washer 109 D rests on top of the disc 109B and supports ring 109A, The washer can be made of a flexible foam or rubber, or alternatively, a spring (not shown) may be added between the disc 109B and ring 109A.

The operation of the composite can opener 10 is now described. The combined can opener is used for two purposes: to open a can, and then to push down its top into the can thereby forcing out some liquid there from for disposal. Initially, the two motors are off, and switch 104 is drawn backward thereby insuring that the knife 108D is drawn up and locked in a position away from wheel 108A. The can 200 is then placed in a conventional manner under the head 102 so that its rim 202 is captured between the sidewalls 108B and the arms 108C. Once the can is firmly seated, the user grasps the handle 101 firmly and with his thumb advances the switch 104 forward thereby causing the knife 108D to be forced downward so that its edge 108E pierces the top 204 of the can 200 at a point adjacent to the rim 202.

Next, the user activates long switch 107 with one of his fingers thereby causing the motor 116 to turn which then turns the train 117 and toothed wheel 108A. The wheel 108A engages the rim 202 and causes the can turn about its vertical axis thereby forcing the knife edge 108E to make a neat, circular cut 206 around the can top 104 in a conventional manner.

Once, the cut is complete and the top 204 is separated from the can 200, the user stops pressing on the long switch 107 causing the wheel 108A to stop turning. The user also returns the switch 104 back to its original position causing the knife 108D to be removed from the can.

In a conventional opener, the user then just removes the can 200 from the composite opener and removes its contents. However, in the present invention, he also has the option of expressing some liquid from the can. For this purpose, the user can push or rock switch 105 forward. This action causes the motor 111 to start turning, which in turn causes the magnet 1098 to lower by a fraction of an inch, while the ring 109A stays in place, until the bottom surface of the magnet 109C becomes approximately co-planar with the bottom of the ring 109A. Thereafter, as the wheel 112A keeps turning, both the magnet and the ring 109A forming the plunger 109 move downward pressing the separated top 204 into the can 200. This action causes some of the liquid to rise through the cut 206 above the top 204. The user can now move the whole assembly, including the composite can opener 10 and can 200 to a sink or above a garbage bag, and tilt the can to cause the expressed liquid to be poured off the can 200. Of course, the remainder of the can 200 is maintained in place by top 204. Depending on the various dimensions and other characteristics of the plunger 109 and its components, the plunger 109 moves downward from ¼-1 in.

Once the liquid is removed, the switch 105 is reversed, causing the gear 112A to reverse direction and the plunger 109 to start rising, thereby removing the can top 204 from the can 200. The can is then removed from the composite can opener. Thereafter, the user can continue to cause the gear 112 to rotate. Toward the end of its travel, the bottom of the magnet is retracted with respect to the bottom of the ring 109A. As a result, the can top 204 is no longer engaged by the magnet 109C and falls away or can be removed by hand.

In the preferred embodiment described above, switch 107 is used to operate the motor 116 for the can opening phase. In an alternate embodiment an automated element, such as a sensor or proximity switch can be used instead to determine when the can 200 is in position and can be opened. In another embodiment, instead of two separate motors 116, 111 for the two separate operations, a single motor can be used with mechanical and/or electrical coupling used to drive one or the other gear trains (Not shown).

Obviously numerous modifications can be made to this invention without departing from its scope as defined in the appended claims.

We claim:

1. A composite can opener for selectively opening a can having a can body and a top, comprising:

an opener body with a handle;

a can gripper attached to said opener body arranged and constructed to grasp the can;

a can opener assembly attached to said opener body and selectively cutting the top of the can being gripped by the gripper assembly;

a plunger mounted on said handle and selectively movable with respect to the can to cause the top to selectively enter the can to cause some liquid to be expressed therefrom, said plunger being spaced apart and separate from the can opener assembly;

an opener electric motor disposed in said opener body and arranged and constructed to selectively power said can opener assembly by rotating the can with respect to said can opener assembly about a can axis extending through the top; and a plunger electric motor disposed in said opener body and arranged and constructed to selectively power said plunger; and an opener gear train coupling said opener electric motor to said can opener assembly and a plunger gear train selectively powering said plunger.

2. The composite can opener of claim 1 wherein said plunger includes a magnet for lifting the top after the top has been pushed into the can.

3. The composite can opener of claim 1 further comprising a plunger gear train coupling said plunger electric motor to said plunger to sequentially lower and raise the top.

4. The composite can opener of claim 1 wherein said body is sized and shaped to be held in one hand substantially above the can while the can is opened and the top is pushed downward into the can, with said handle fitting into the palm of the hand.

5. The composite can opener of claim 1 wherein said can opener assembly is adapted to make a cut around the top when cutting the top, and wherein the plunger cooperates with said can opener assembly to cause the liquid from the can to flow through said cut above the top.

6. A composite can opener for opening a can having a top and a lip surrounding the top comprising:

a body having a head and a handle, at least one of said head and handle housing a battery, an opener electric motor powered by said battery, an opener gear train coupled to said opener electric motor, a plunger electric motor powered by said battery and a plunger gear train coupled to said plunger electric motor;

a can gripping member attached to said head and being sized and shaped to grip and hold the lip on the can;

a can opener assembly driven by said opener gear train and said opener electric motor and disposed adjacent to said can gripping member to selectively and rotatably cut the top of the can adjacent to the grip; and a plunger disposed adjacent to said can opener assembly and being configured to be selectively raised and lowered through the can by said plunger gear train and said plunger electric motor to push the can top into can and thereby express some liquid therefrom and to remove the can top thereafter; and a first switch adapted to initiate an opening in the can, wherein said can opener includes a knife selectively raised and lowered by the first switch.

7. The composite can opener of claim 6 further comprising a second switch selectively activating said opener electric motor for performing the cut.

8. The composite can opener of claim 6 further comprising a third switch for selectively activating said plunger electric motor.

* * * * *